United States Patent [19]

Hendricks

[11] Patent Number: 4,545,362

[45] Date of Patent: Oct. 8, 1985

[54] GOLF BALL HEATER

[76] Inventor: Willard E. Hendricks, P.O. Box 389, Checotah, Okla. 74426

[21] Appl. No.: 626,470

[22] Filed: Jun. 29, 1984

Related U.S. Application Data

[63] Continuation of Ser. No. 387,498, Jun. 11, 1982, abandoned.

[51] Int. Cl.[4] ..... F24J 1/00

[52] U.S. Cl. ..... 126/263; 206/315.9; 273/32 D

[58] Field of Search ..... 126/263, 400; 273/32 R, 273/32 D, 62; 128/403; 206/315.9

[56] References Cited

U.S. PATENT DOCUMENTS

| | | | |
|---|---|---|---|
| 2,181,821 | 11/1939 | Seals | 126/208 X |
| 2,596,664 | 5/1952 | Durham et al. | 126/263 |
| 2,733,710 | 2/1956 | Zibell | 126/263 |
| 3,683,155 | 8/1972 | Loofbourow | 219/439 X |
| 3,720,197 | 3/1973 | Schroth | 126/451 |
| 3,773,461 | 11/1973 | Arimoto et al. | 126/263 X |
| 4,287,943 | 9/1981 | Hotta | 126/400 X |

*Primary Examiner*—Randall L. Green

*Attorney, Agent, or Firm*—Head, Johnson & Stevenson

[57] ABSTRACT

A golf ball heater comprising a sectional housing which may be readily separated for access to the interior of the housing and secured together to provide a closed housing for receiving a plurality of golf balls therein. A hand warmer such as that known as HOT MINI is disposed within the housing, and the housing is provided with ports providing for flow of air to the warmer for activation thereof when it is desirable to heat the golf balls. The warmer may be returned to a storage pack for deactivation during periods of non-use.

5 Claims, 2 Drawing Figures

GOLF BALL HEATER

CROSS REFERENCE TO RELATED APPLICATION

This application is a continuation of application Ser. No. 387,498, filed June 11, 1982, which is now abandoned.

This application is related to my co-pending application Ser. No. 156,277, filed June 4, 1980, and entitled "Heater for Golf Balls."

BACKGROUND OF THE INVENTION

1. Field of the Invention

This invention relates to improvements in golfing apparatus and more particularly, but not by way of limitation, to a simple and inexpensive heater for golf balls.

2. Description of the Prior Art

The game of golf has been popular throughout most parts of the world for many years, and in the past much of the playing of the game was limited to time periods of relatively pleasant weather. With the increasing popularity of the game in recent years, however, the game is being played more consistently throughout the entire year, both during warm or hot temperature seasons, and colder temperature seasons. It is well known that a golf ball is much more "lively" when the ambient temperatures are warm or hot than when the surrounding temperatures are reduced or cold. The warm atmosphere maintains the golf ball relatively warm as it moves through the air during the playing of the game, and the golfer is able to realize much greater distances for his shots. In colder atmospheric conditions, however, the temperature of the air through which the ball passes reduces the temperature of the ball, and the driving distance of the golfing shots is usually considerably reduced. As the number of golfers playing the game during more inclimate weather conditions has increased, many players have recognized the disadvantages of reduced temperature conditions acting on a golf ball and have endeavored to warm the balls in many ways. For example, a golfer may carry a plurality of balls along with a typical hand warmer in a common bag or sack whereby the heat of the hand warmer may be transmitted to the balls.

In addition, the Loofbourow U.S. Pat. No. 3,683,155, issued Aug. 8, 1972 and entitled "Golf Ball Heater" discloses a housing having a partition provided therein which supports a plurality of golf balls in an annular trough. A heating element is disposed below the partition for heating the interior of the housing, and the partition is provided with apertures for permitting the circulation of the heated air over the exposed upper surfaces of the golf balls. This device has certain disadvantages in that a large portion of each ball is engaged by the supporting trough, and the circulation of warm air is not directed around the entire outer periphery of the golf balls. My co-pending application, Ser. No. 156,277, filed June 4, 1980, and entitled "Heater for Golf Balls" relates to a forced air heating apparatus for golf balls and comprises a housing for supporting a plurality of golf balls in such a manner that heated air is driven through the interior of the housing and around substantially the entire outer periphery of each golf ball supported therein. The forced air golf ball heater is excellent, but it is also particularly designed for use in combination with a golfing cart, although it may also be utilized independently of such a cart. Many persons playing golf may choose not to use a golfing cart, and in addition, persons who do not play the game with regularity may consider the expense of the novel forced air golf ball heater excessive for their particular purpose.

SUMMARY OF THE INVENTION

The present invention contemplates a novel golf ball heater which has been particularly designed for achieving an efficient heating of a golf ball, but is of a simple and inexpensive construction, thus enhancing the widespread use of the device even by players who play the game only occasionally. The novel golf ball heater comprises a sectional container or housing having the opposite ends thereof closed and separable along a longitudinal juncture between the two sections. The cross sectional configuration of the container is preferably substantially circular for receiving a hand and body warmer snugly against the inner periphery of the sidewalls thereof. Substantially any desired number of golf balls may be disposed within the interior of the container and since the overall dimensions of the container are preferably relatively small, the air confined within the container will be efficiently warmed by the hand and body warmer, thus applying heat to the golf balls contained therein. The hand and body warmer is preferably of a disposable type commonly known as "HOT MINI", distributed by HOT MINI INTERNATIONAL, INC., 360 Swift Avenue, No. 26, South San Francisco, Calif. This warmer is yieldable or flexible for readily conforming to the inner periphery of the container, and is of a size for disposition within one section of the housing. When air is allowed to contact the outer surface of the HOT MINI warmer, a reaction is initiated whereby heat is radiated therefrom. Accordingly, a plurality of apertures are provided in the container for admitting ambient air into the interior of the container for activation of the warmer when desired. The normal active life expectancy of the disposable HOT MINI warmer is approximately fifteen hours, after which it may be discarded and replaced with a new warmer, as required.

It is to be noted that the HOT MINI warmer is normally packaged in a self-storing type container, and when the heat radiation from the warmer is not required, the warmer may be stored within the storage package, thus stopping the warming action. When the heating action is again required, the HOT MINI warmer may be removed from the storage package and again energized by contact with a source of air, whereupon the heating process is restored. In this manner, a single HOT MINI warmer may be utilized repeated in the novel golf ball heating container as required. The novel golf ball heater is simple and efficient in operation and economical and durable in construction.

DETAILED DESCRIPTION OF THE PREFERRED EMBODIMENT

Figure 2:
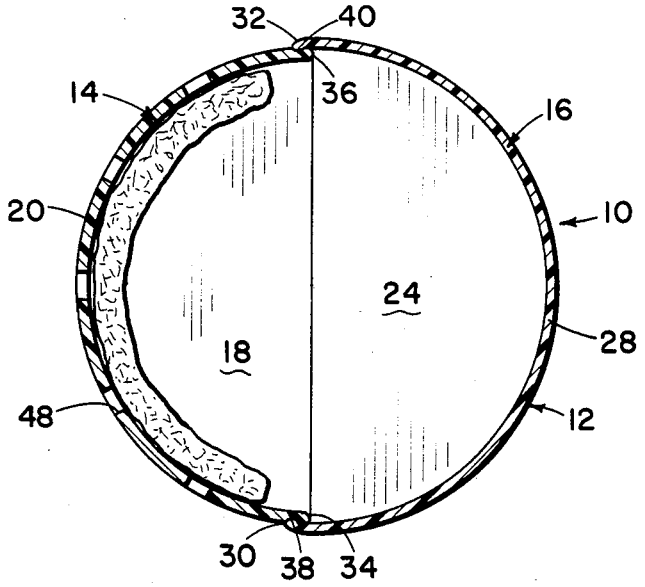
FIG. 2 is a view taken on line 2—2 of FIG. 1.
Figure 1:
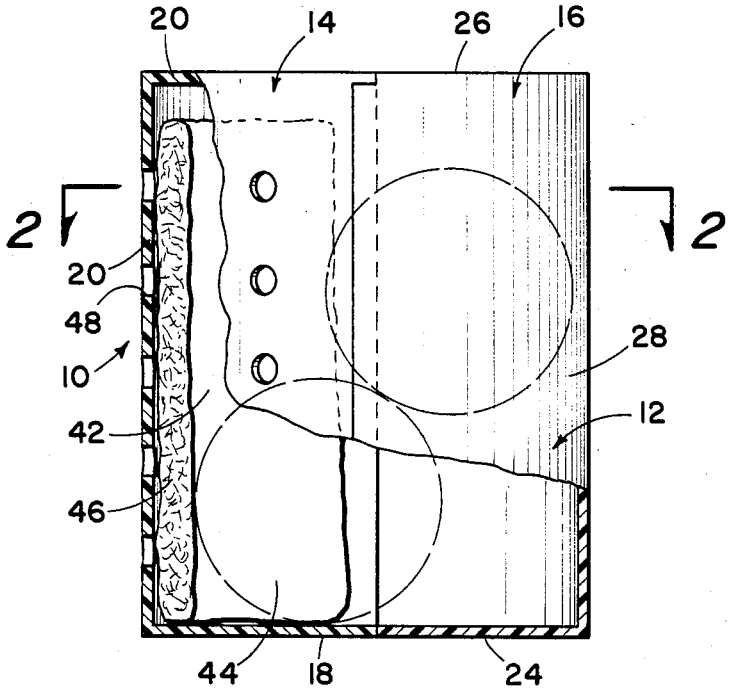
FIG. 1 is a side elevational view, partly in section, of a golf ball heater embodying the invention.

Referring to the drawings in detail, reference character 10 generally indicates a golf ball heater comprising a sectional container or housing 12 preferably of a substantially circular cross sectional configuration, but not limited thereto. The housing 12 preferably comprises a pair of substantially identical but oppositely disposed half sections 14 and 16 removably secured together in a manner as will be hereinafter set forth. The half section 14 comprises a pair of spaced substantially identical semicircular end plates 18 and 20 connected together in spaced relation by a substantially semicylindrical wall 22. The half section 16 comprises a pair of substantially identical semicircular end plates 24 and 26 secured together in spaced relation by a substantially semicylindrical wall 28. One of the half sections, such as the half section 16 is preferably of a cross sectional configuration or diameter slightly greater than cross sectional configuration or diameter of the other half section 14, as particularly shown in FIG. 2 whereby the outer longitudinal edges 30 and 32 of the wall 28 slightly overlap the outer longitudinal edges 34 and 36, respectively, of the wall 20. In addition, it may be preferable to provide a relatively slight longitudinally extending indentation 38 and 40 on the outer periphery of the wall 20 in the proximity of the edges 34 and 36, respectively, as shown in FIG. 2 for removably receiving the edges 30 and 32 of the wall 28 therein.

Each end plate 18 and 20 of the half section 14 is preferably of a substantially semicircular configuration. Similarly, each end plate 24 and 26 of the half section 16 is preferably of a substantially semicircular configuration whereby the outer edges of the end plates of the half sections are disposed in abutting relationship in the assembled position between the two half sections. In this manner, the container or housing 12 becomes encased by the abutting walls 20 and 28 and each end of the housing 12 is closed by the abutting end plates of the half sections, thus providing a closed internal chamber 42 within the container for receiving a plurality of golf balls 44 therein.

One of the half sections, such as the half section 14, is adapted for receiving a suitable hand and body warmer 46 against the inner periphery of the wall 20 thereof. The warmer 46 is preferably of the type known as HOT MINI, distributed by HOT MINI INTERNATIONAL, INC. as hereinbefore set forth. The HOT MINI warmer is activated by contact with ambient air to product heat. Accordingly, the wall 20 is provided with a plurality of spaced apertures 48 which establish communication between the exterior of the container 12 and the warmer 46. The admission of the air through the ports or apertures 48 into contact with the warmer 46 activates the warmer for radiating heat into the chamber 42 surrounding the golf balls 44, thus warming the balls as they are stored in the container 12.

In use, the warmer 46 may be stored within the container 12 in its prepackaged condition until it is desired to transmit heat to the golf balls 44. The package (not shown) normally provided for the warmer 46 precludes contact of the warmer with air, thus inhibiting the activation of the warmer until it is necessary or desired. When the balls 44 within the chamber 42 are to be heated, the half sections 14 and 16 may be separated by manually pulling the sections in opposite radial directions, thus providing access to the warmer stored thereon. (Of course, if desired, the warmer 46 need not be placed in the container 12 at all until it is desired to utilize the warming effects thereof.) The warmer may be removed from the storage package thereof and positioned against the wall 20 in the proximity of the bores or apertures 48 whereby air is admitted into contact with the warmer 46 for activation thereof. The half sections 14 and 16 may be secured together by manual pressure applied in reverse directions with respect to the separation pressure, and the golf balls 44 will be housed or contained within the compartment 42 in somewhat intimate relation with respect to the warmer 46 for receiving heat therefrom. When the balls 42 are to be used, the half sections 14 and 16 may be separated as hereinbefore set forth for access to the chamber 42 whereby the balls may be retrieved for normal use. Of course, the balls may be restored to the storage position in the chamber 42 when a reheating thereof is required or desired.

Subsequent to a period of use of the warmer 46 and container 12, it may be desirable to store the balls 44 and warmer 46 for future use. In this event, the warmer 46 may be retrieved from the chamber 42 and replaced in the normal storage package (not shown) therefor whereby the contact of air with the warmer will be eliminated, thus stopping the heating action of the warmer. The packaged warmer and balls may be retained within the container 12 until such time as it is again desired to heat the balls for use during a golf game or golfing practice session.

From the foregoing it will be apparent that the present invention provides a novel golf ball heater which is of a simple and economical construction, and which may be readily utilized under substantially any golfing situation, whether the golfer is using a golfing cart, or not. The novel golf ball heater comprises a sectional housing which may be easily opened for access to the interior thereof. A selectively actuatable warmer device may be placed within the container for activation as desired or required for radiating heat to golf balls disposed in the proximity thereof. The warmer may be stored within the container in an inactive condition during periods of use of the device, if desired.

Whereas the present invention has been described in particular relation to the drawings attached hereto, it should be understood that other and further modifications, apart from those shown or suggested herein may be made within the spirit and scope of this invention.

What is claimed is:

1. A golf ball heater comprising:

sectional housing means having an unobstructed internal chamber therein;

a golf ball received in said housing; and a relatively thin, flexible disposable warmer means of dimensions less than the internal dimensions of said chamber, said warming means being activated by contact with air to generate heat, said flexible warming means being disposed within the internal chamber, the chamber having an internal diameter slightly larger than said golf ball and being configured to conform to and engage at least a portion of the inner periphery of the housing and surrounding and contacting at least a portion of said golf ball loosely disposed within the chamber, said housing being provided with aperture means in the proximity of the warmer means for providing communication between the exterior of the housing and the internal chamber for transmitting external air into contact with the warmer means for actuation thereof and to direct warm air around the entire outer periphery of said golf ball.

2. A golf ball heater as set forth in claim 1 wherein the sectional housing means comprises a pair of substantially identical oppositely disposed half-sections separable to provide access to the internal chamber whereby the golf ball may be deposited therein and retrieved therefrom.

3. A golf ball heater as set forth in claim 2 wherein the housing means is of a substantially circular cross sectional configuration, and wherein the half sections are separable along a longitudinal dimension of the housing means.

4. A golf ball heater as set forth in claim 3 and including detent means provided along the outer longitudinal edges of at least one of the half sections for facilitating removably securing the half sections in an engaged position therebetween.

5. A golf ball heater as set forth in claim 3 wherein each of said half sections is provided with a pair of end plates secured in spaced relation by an arcuate wall whereby the housing means is provided with closed ends when the half sections are in mutual engagement.

* * * * *